US006042631A

United States Patent [19]

Kondoh et al.

[11] Patent Number: 6,042,631

[45] Date of Patent: Mar. 28, 2000

[54] ALN DISPERSED POWDER ALUMINUM ALLOY AND METHOD OF PREPARING THE SAME

[75] Inventors: Katsuyoshi Kondoh, Hyogo; Atsushi Kimura, Osaka; Yoshishige Takano, Hyogo, all of Japan

[73] Assignee: Sumitomo Electric Industries, Ltd., Osaka, Japan

[21] Appl. No.: 09/019,654

[22] Filed: Feb. 6, 1998

[30] Foreign Application Priority Data

Feb. 7, 1997 [JP] Japan ..... 9-025370

[51] Int. Cl.[7] ..... B22F 3/16; B22F 3/24

[52] U.S. Cl. ..... 75/244; 75/249

[58] Field of Search ..... 75/244, 249

[56] References Cited

U.S. PATENT DOCUMENTS

| | | | |
|---|---|---|---|
| 4,838,936 | 6/1989 | Akechi | 75/249 |
| 5,374,295 | 12/1994 | Miura et al. | 75/44 |
| 5,387,212 | 2/1995 | Kamitguma et al. | 75/230 |
| 5,435,825 | 7/1995 | Kusui et al. | 75/232 |
| 5,436,080 | 7/1995 | Inoue et al. . | |
| 5,605,558 | 2/1997 | Yamagata et al. | 75/230 |
| 5,635,654 | 6/1997 | Hebsur et al. | 75/244 |

FOREIGN PATENT DOCUMENTS

| | | |
|---|---|---|
| 0704543 | 4/1996 | European Pat. Off. . |
| 6-33164 | 2/1994 | Japan . |
| 6-57363 | 3/1994 | Japan . |

*Primary Examiner*—Daniel J. Jenkins
*Attorney, Agent, or Firm*—W. F. Fasse; W. G. Fasse

[57] ABSTRACT

An AlN dispersed powder aluminum alloy with a particular composition and structure has excellent wear resistance, seizure resistance, heat resistance, toughness and machinability. In the structure of the alloy, AlN layers are discontinuously dispersed along some of the grain boundaries of former aluminum alloy particles in the matrix of an aluminum alloy sintered body. Diffusion and sintering progresses between non-nitrided grains at areas of grain boundaries not having AlN layers, to attain strong bonding between the grains. A nitriding accelerative element such as Mg, Ca or Li is provided in some of the grains to promote the discontinuous formation of the AlN layers. Additionally, layers of a nitriding suppressive element such as Sn, Pb, Sb, Bi or S may be discontinuously dispersed at regions along some of the grain boundaries, and bonding between grains is achieved at these regions as well. The alloy is prepared by sintering a green powder compact of prescribed composition under prescribed sintering conditions.

35 Claims, 6 Drawing Sheets

ALN DISPERSED POWDER ALUMINUM ALLOY AND METHOD OF PREPARING THE SAME

BACKGROUND OF THE INVENTION

1. Field of the Invention

The present invention relates to an aluminum nitride (AlN) dispersed powder aluminum alloy, and more particularly, it relates to an aluminum nitride dispersed powder aluminum alloy that is lightweight, high in wear resistance, seizure resistance, heat resistance and thermal properties and that has excellent toughness and machinability, and to a method of preparing the same. Such an alloy is applicable to compressor parts such as a vane and a rotor, sliding parts such as an oil pump rotor and a shoe, engine parts such as a valve lifter, a retainer, a cylinder liner and a connecting rod, and a heat sink.

2. Description of the Prior Art

A generally known wear-resistant powder aluminum alloy is prepared by mixing and adding hard grains or fibers of alumina ($Al_2O_3$), silicon carbide (SiC) or aluminum nitride (AlN), for example, into an aluminum alloy powder forming the base, in order to improve its wear resistance, conformability to a counter material and counter attackability. However, such hard grains or fibers come loose and fall out from the base during sliding and thereby form an abrasion powder, which disadvantageously induces abrasion damage or seizure to reduce the wear resistance. Namely, the hard grains simply added to the base fall out during sliding to induce seizure or abrasion. In preparation of the wear-resistant powder aluminum alloy, further, the added hard grains having fine grain diameters of about 3 to 10 $\mu$m segregate or aggregate to reduce mechanical properties or wear resistance of a resulting sintered body. In order to solve this problem, the mixing step must be repeatedly carried out. In addition, the employment of high-priced hard grains leads to an economic problem.

In order to suppress the problem of hard grains falling out of the base during sliding, methods of dispersing hard grains in aluminum alloys without simply adding the grains to the base have been studied. Such methods include a method of heating a raw material powder mainly composed of aluminum (Al) in a nitrogen gas atmosphere for continuously forming and dispersing AlN having excellent slidability on old or prior grain boundaries or on old or prior grain surfaces by direct reaction between nitrogen gas (N) and Al. For example, Japanese Patent laying-Open No. 6-57363 (1994) "Nitrogen Compound Aluminum Sintered Alloy and Method of Preparing the Same" or Japanese Patent Laying-Open No. 6-33164 (1994) "Method of Preparing Nitride Dispersed Al Alloy Member" disclose such a method. According to this method, the AlN coating layers are homogeneously formed and dispersed on all old or prior grain boundaries or on old or prior grain surfaces forming the base for a powder aluminum alloy, whereby a powder aluminum alloy having excellent wear resistance and seizure resistance can be prepared.

In such a powder aluminum alloy prepared by forming and dispersing AlN coating layers by nitriding, however, the nitriding takes place continuously and substantially uniformly on all grain surfaces of the aluminum alloy as described above, and hence the resulting AlN coating layers exist continuously on all prior grain boundaries or prior grain surfaces in a sintered body. Consequently, the AlN coating layers inhibit the metallic diffusion bonding ability between the prior grains, and thus remarkably reduce the toughness of the material, such as the elongation or the impact value. When the powder aluminum alloy is worked into a component, weak bonding between the grains results in a problem in machinability, such as chipping on an end portion of a sample. In addition, remarkable plastic deformation must be applied in order to part the AlN coating layers that have been continuously formed in the aluminum alloy, leading to a remarkable restriction on the possible shape of the component.

SUMMARY OF THE INVENTION

Accordingly, an object of the present invention is to provide an AlN dispersed powder aluminum alloy having excellent wear resistance, seizure resistance and heat resistance as well as excellent toughness and machinability with excellent economy and without reducing the bonding ability between prior grains, by controlling the dispersed state of AlN coating layers.

An AlN dispersed powder aluminum alloy according to an aspect of the present invention comprises an aluminum alloy sintered body having a matrix with grain boundaries defined by the aluminum alloy powder that served as the starting material, and AlN layers discontinuously dispersed along the grain boundaries. In a preferred embodiment, the AlN layers enclose partial grains or some of the grains of the prior aluminum alloy powder, without enclosing the remaining grains.

An AlN dispersed powder aluminum alloy according to another aspect of the present invention comprises an aluminum alloy sintered body having a matrix with grain boundaries defined by the aluminum alloy powder that served as the starting material, AlN layers discontinuously dispersed along the grain boundaries, and nitriding suppressive element layers containing an element that suppresses nitriding discontinuously dispersed along the grain boundaries. In a preferred embodiment, the AlN layers enclose partial grains or some of the grains of the prior aluminum alloy powder, while the nitriding suppressive element layers enclose the remaining grains.

An AlN dispersed powder aluminum alloy according to still another aspect of the present invention comprises an aluminum alloy sintered body and AlN layers discontinuously dispersed in the matrix of the sintered body. In a preferred embodiment, parts or regions that are enclosed with the AlN layers and parts or regions that are not enclosed with AlN layers are mixed in the matrix.

An AlN dispersed powder aluminum alloy according to a further aspect of the present invention comprises an aluminum alloy sintered body, AlN layers discontinuously dispersed in the matrix of the sintered body, and nitriding suppressive element layers containing an element that suppresses nitriding discontinuously dispersed in the matrix of the sintered body. In a preferred embodiment, parts or regions that are enclosed with the AlN layers and parts or regions that are enclosed with the nitriding suppressive element layers are mixed in the matrix.

The nitriding suppressive element is preferably selected from a group consisting of Sn, Pb, Sb, Bi and S.

In another preferred embodiment, the aluminum sintered body contains in its matrix a nitriding accelerative element that accelerates nitriding. The content of the nitriding accelerative element in regions enclosed with the AlN layers is larger than that in the regions not enclosed with the AlN layers. The nitriding accelerative element is preferably selected from a group consisting of Mg, Ca and Li.

In still another preferred embodiment, the aluminum sintered body contains the nitriding accelerative element and the nitriding suppressive element in its matrix. In the regions enclosed with the AlN layers, the content of the nitriding accelerative element is at least 0.05 percent by weight, and the content of the nitriding suppressive element is less than 0.01 percent by weight. In the regions not enclosed with the AlN layers, the content of the nitriding accelerative element is less than 0.05 percent by weight. In another embodiment, there are preferably regions enclosed with the nitriding suppressive element layers, wherein the content of the nitriding accelerative element is at least 0.05 percent by weight, and that of the nitriding suppressive element is at least 0.01 percent by weight and not more than 2 percent by weight.

In a method of preparing an AlN dispersed powder aluminum alloy according to an aspect of the present invention, a first step involves preparing a mixed powder of a first aluminum alloy powder containing at least 0.05 percent by weight of a nitriding accelerative element and less than 0.01 percent by weight of a nitriding suppressive element with the rest or remainder substantially composed of Al (herein "substantially composed of Al" means Al and trivial amounts of natural or unavoidable impurities or other additives) and a second aluminum alloy powder containing less than 0.05 percent by weight of a nitriding accelerative element with the remainder substantially composed of Al. Then, this mixed powder is compression-molded to form a compact. Then, this compact is heated and sintered in an atmosphere containing nitrogen gas, for discontinuously dispersing AlN layers in the matrix of the sintered body.

In a method of preparing an AlN dispersed powder aluminum alloy according to another aspect of the present invention, a first step involves preparing a mixed powder of a first aluminum alloy powder containing at least 0.05 percent by weight of a nitriding accelerative element and less than 0.01 percent by weight of a nitriding suppressive element with the rest or remainder substantially composed of Al, and a third aluminum alloy powder containing at least 0.05 percent by weight of a nitriding accelerative element and at least 0.01 percent by weight and not more than 2 percent by weight of a nitriding suppressive element with the remainder substantially composed of Al. Then, this mixed powder is compression-molded for forming a compact. Then, this compact is heated and sintered in an atmosphere containing nitrogen gas, for discontinuously dispersing AlN layers in the matrix of the sintered body.

Preferably, each of the above mentioned first, second and third aluminum alloy powders is prepared by rapid solidification of molten aluminum alloy at a solidification rate of at least 100° C./sec.

Further preferably, the ratio of the first aluminum alloy powder to the overall mixed powder is not more than 90% in terms of weight. The minimum grain diameter of the aluminum alloy powder is preferably at least 15 $\mu$m. The temperature for sintering the compact is preferably at least 450° C. and not more than 570° C.

When sintering a compact consisting of an aluminum alloy powder in a nitrogen atmosphere and forming AlN coating layers on grain surfaces of the aluminum alloy powder through nitriding, thereby preparing a sintered aluminum alloy having excellent slidability, it is possible to provide an AlN dispersed powder aluminum alloy having excellent wear resistance, seizure resistance and heat resistance as well as excellent toughness and machinability, with excellent economy and without reducing the bonding ability between the old or prior grains of the aluminum alloy powder, by controlling the dispersed state of the AlN coating layers according to the present invention.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS AND OF THE BEST MODE OF THE INVENTION

The difference in structure between an AlN dispersed powder aluminum alloy prepared by the aforementioned conventional method employing nitriding on the one hand, and an aluminum alloy according to the present invention on the other hand, will now be described with reference to model diagrams shown in FIGS. 1 and 2.

Figure 1:
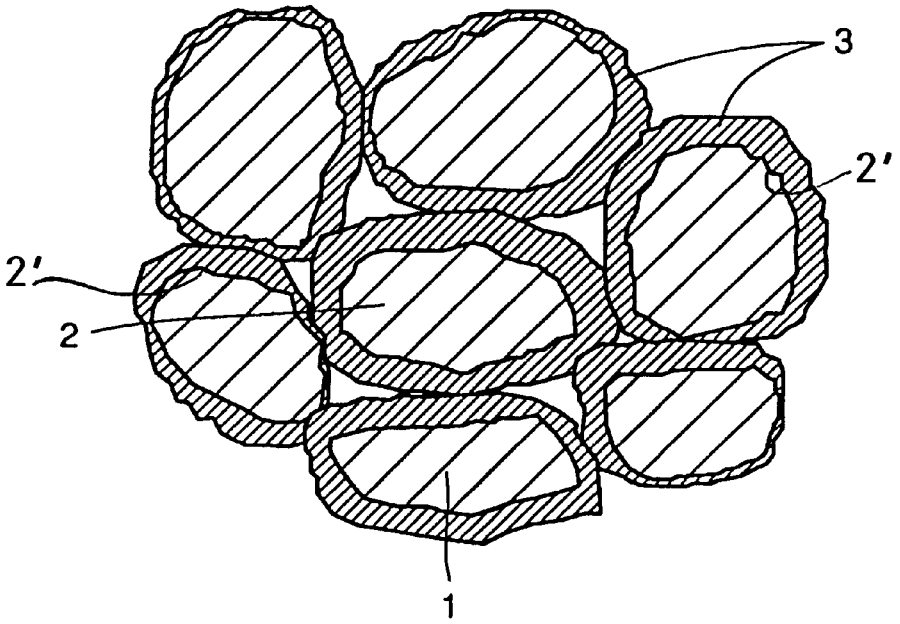
FIG. 1 PRIOR ART
FIG. 1 is a schematic cross-section typically illustrating the structure of a conventional AlN dispersed powder aluminum alloy.

When a powder compact of the conventional AlN dispersed powder aluminum alloy is heated and sintered in a nitrogen gas atmosphere according to the prior art, nitriding takes place homogeneously on all grain surfaces of the aluminum alloy forming the compact, so as to homogeneously form AlN coating layers 3 on all old or prior grain boundaries or on old or prior grain surfaces 2' of the aluminum alloy, as shown in FIG. 1. Consequently, the AlN coating layers 3 homogeneously enclose adjacent old or prior grains 1 and 2, for example, due to the nitriding, and thus inhibit the old grains 1 and 2 from metallic bonding with each other. As such, the AlN coating layers 3 form a continuous interconnected network of AlN with the grains 1 and 2 enclosed or encased therein.

As to influences exerted by the AlN coating layers 3 on the mechanical properties of the conventional powder aluminum alloy having such a structure, the strength and hardness of the aluminum alloy are improved by the dispersion reinforcing mechanism of the AlN coating layers 3, while the toughness, as represented by properties such as the elongation or an impact value, is reduced due to a reduction of the bonding ability between the old grains 1 and 2. When a sample of such a conventional powder aluminum alloy is cut with a lathe or a mill, the insufficient bonding ability between the old grains results in a problem in machinability such as chipping (fragmentation) on an end portion of the sample.

Figure 2:
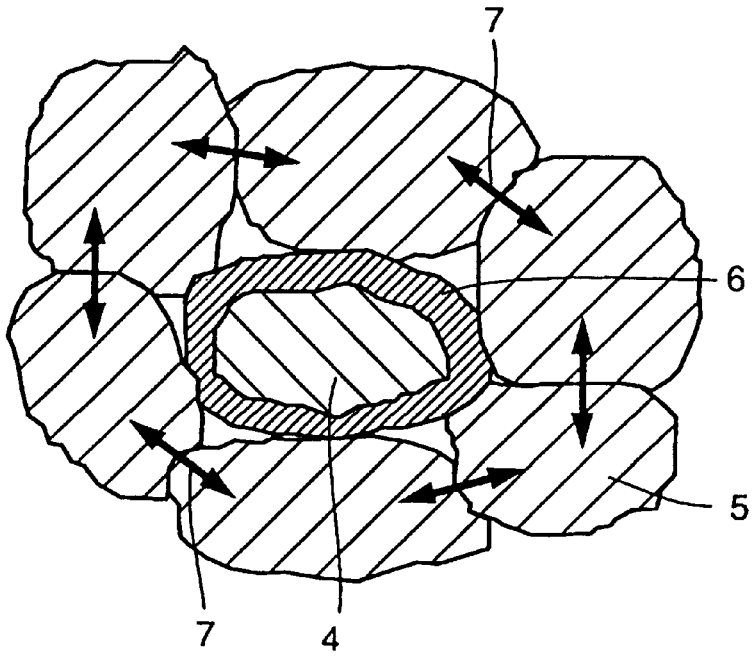
FIG. 2 is a schematic cross-section typically illustrating an exemplary structure of an AlN dispersed powder aluminum alloy according to the present invention.

In the AlN dispersed powder aluminum alloy according to the present invention as shown in FIG. 2, on the other hand, an AlN coating layer 6 encloses only an old or prior grain boundary or an old or prior grain surface of a partial old grain or of only some of the old grains (e.g., an old grain 4), while the remaining old grains (e.g., an old grain 5) are not enclosed with AlN coating layers but are metallically bonded (e.g. diffused and sintered) with each other as shown in FIG. 2. Thus, the inventive AlN dispersed powder aluminum alloy has a structure in which AlN coating layers are independently and discontinuously dispersed in the overall base of the aluminum alloy. Referring to FIG. 2, arrows 7 indicate areas in which old or prior grains are diffused or sintered to each other. It has been confirmed that toughness (such as elongation or an impact value), which has been insufficient in the conventional AlN dispersed powder aluminum alloy prepared by nitriding, and machinability of the aluminum alloy are improved due to improvement of the bonding ability between the old grains in the powder aluminum alloy having the aforementioned structure according to the invention. Additionally, the inventive powder aluminum alloy exhibits improvement of other characteristics such as the wear resistance, strength and hardness due to dispersion of the AlN coating layers.

Figure 3:
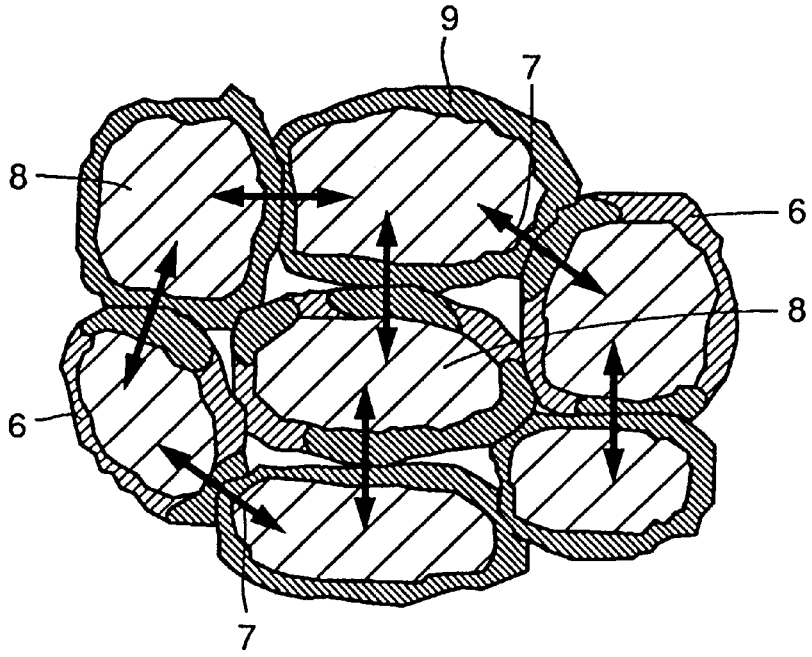
FIG. 3 is a schematic cross-section typically illustrating another exemplary structure of the AlN dispersed powder aluminum alloy according to the present invention.
Figure 4:
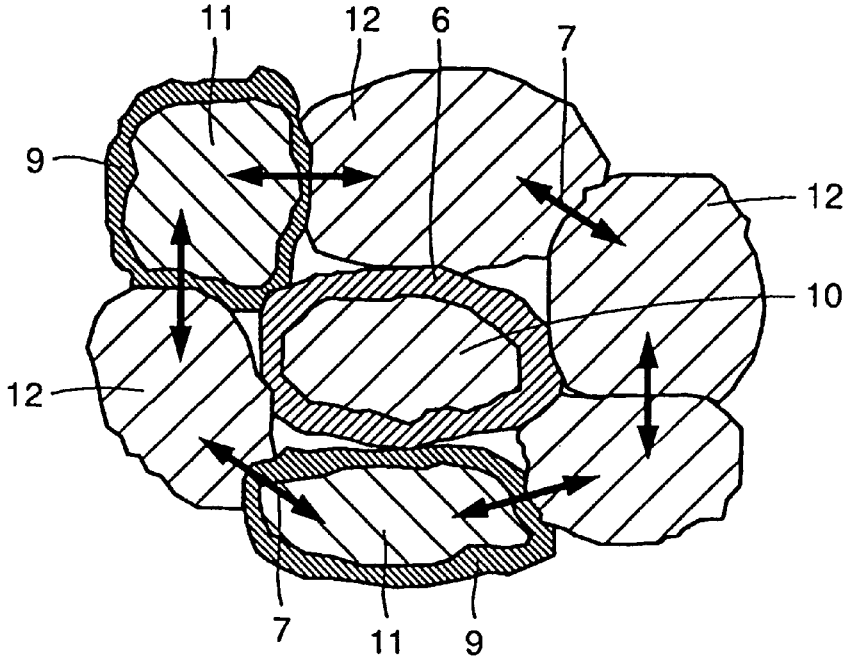
FIG. 4 is a schematic cross-section typically illustrating still another exemplary structure of the AlN dispersed powder aluminum alloy according to the present invention.

FIGS. 2, 3 and 4 show conceivable structures of the powder aluminum alloy having AlN coating layers formed on only certain old grain boundaries or surfaces and not on others, according to the present invention. The features of the respective structures are now described.

In the structure shown in FIG. 2, the AlN coating layer 6 exists only along a portion of the old grain boundary area. Namely, such AlN coating layers are discontinuously dispersed in the overall base of the aluminum alloy, resulting in mixture of some grains such as the old aluminum alloy grain 4 that are enclosed with the AlN coating layer 6 and some grains such as the old aluminum alloy grain 5 that are not enclosed with an AlN coating layer. The old grains that are not enclosed with AlN coating layers are diffused and sintered and thereby metallically strongly bonded with each other.

In the structure shown in FIG. 3, AlN coating layers 6 and coating layers 9 consisting of a nitriding suppressive element are formed along different portions of the old grain boundaries. Therefore, all old grains 8 are enclosed with the AlN coating layers 6 at some grain boundary areas and the nitriding suppressive element layers 9 at some other grain boundary areas, which are mixed with each other. The old grains 8 are diffused and sintered to each other in portions where the nitriding suppressive element layers 9 are in contact with each other, as shown by arrows 7.

In the structure shown in FIG. 4, an old or prior aluminum alloy grain 10 enclosed with an AlN coating layer 6, old or prior aluminum alloy grains 11 enclosed with nitriding suppressive element layers 9, and non-nitrided old aluminum alloy grains 12 are mixed with each other. The old aluminum alloy grains 11 and 12 are diffused and sintered together in portions where the grains 12 are in contact with each other and with the grains 11, as shown by arrows 7.

Figure 5:
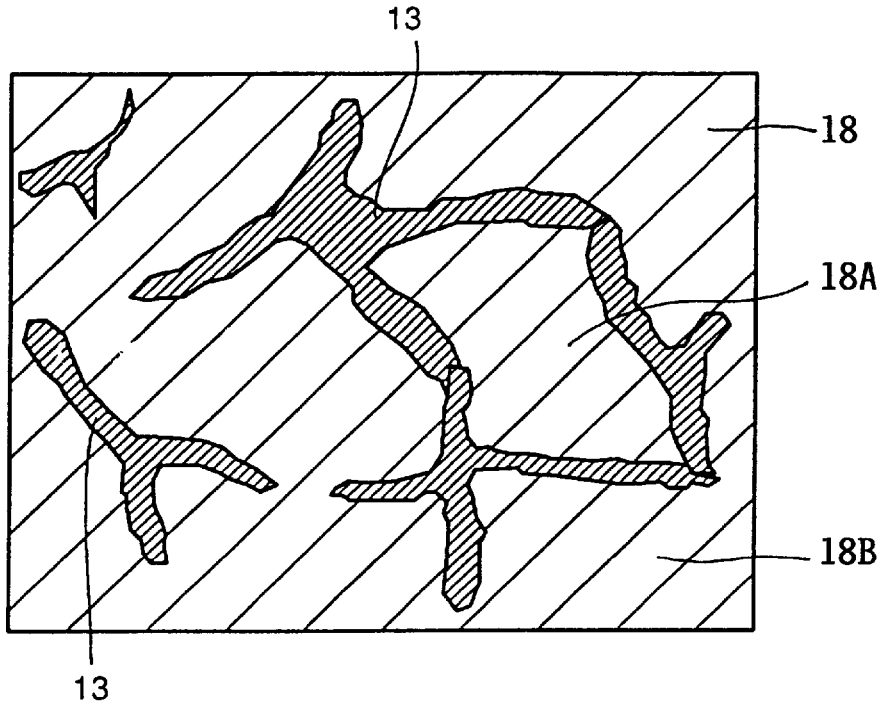
FIG. 5 is a schematic cross-section typically illustrating a further exemplary structure of the AlN dispersed powder aluminum alloy according to the present invention.
Figure 6:
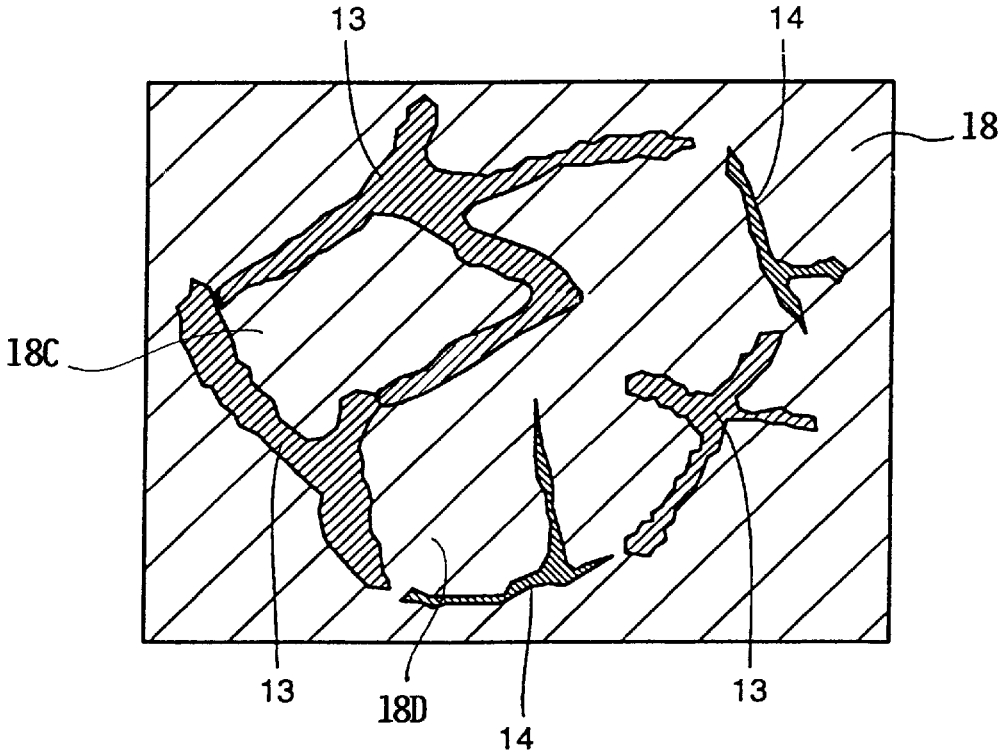
FIG. 6 is a schematic cross-section typically illustrating a further exemplary structure of the AlN dispersed powder aluminum alloy according to the present invention.

FIGS. 5 and 6 show structures defined as those of the inventive powder aluminum alloy having no clearly appearing old grain boundaries. In other words, the prior aluminum alloy powder grains have fused together at locations such as those shown by arrows 7 in FIGS. 2, 3 and 4, to form a fused matrix 18 or overall base 18 of the aluminum alloy.

In the structure shown in FIG. 5, AlN layers 13 are discontinuously dispersed in the overall base 18 of the aluminum alloy, such that there is a mixture of regions 18A enclosed by the AlN layers 13 and regions 18B not enclosed by AlN layers 13.

In the structure shown in FIG. 6, regions 18C enclosed with AlN layers 13 and regions 18D enclosed or partially enclosed with nitriding suppressive element layers 14 are mixed with each other. In the overall aluminum alloy, areas consisting of the AlN coating layers 13 and areas consisting of the nitriding suppressive element coating layers 14 are mixed with each other.

The term "nitriding suppressive element" indicates an element that does not form a compound with aluminum (Al) serving as the powder base, but does form a liquid phase or a vapor phase in a temperature range lower than the sintering temperature. In more concrete terms, the term "nitriding suppressive element" indicates a high vapor pressure element such as Sn, Pb, Sb, Bi or S.

The structure of the AlN dispersed powder aluminum alloy according to the present invention and a method of preparing the same are now described as follows. The reason why the structure of the inventive AlN dispersed powder aluminum alloy is restricted as mentioned above is now also described.

Essential Composition of Starting Material Powder

An important feature of the present invention resides in that AlN coating layers are not formed on all old grain boundaries or surfaces in the base or matrix of the powder aluminum alloy, but instead are partially independently dispersed and formed on only certain old grain boundaries for ensuring the presence of old grain boundaries that are not provided with such AlN coating layers. When sintering a powder compact in a nitrogen gas atmosphere, AlN coating layers are formed on grain surfaces by nitriding grains of a composition forming the powder compact, while nitriding is inhibited and thus does not form AlN coating layers on grains of another composition. Namely, the inventors have contrived a powder aluminum alloy having a structure in which AlN coating layers present on some of the old grain boundaries are independently dispersed in the overall powder aluminum alloy by expressly controlling the structure so as to form the AlN coating layers only on certain old grain boundaries and not on others. The inventors have carried out various experiments and analyses, and as a result have determined that it is possible to prepare a powder aluminum alloy having such a structure in which AlN coating layers are formed and dispersed only on certain old grain boundaries as shown in the model diagram of FIG. 2, 3 or 4, by blending, mixing and stirring respective powder materials with each other in prescribed ratios in a combination of a first aluminum alloy powder (hereinafter referred to as nitriding accelerative Al powder) that is capable of accelerating nitriding and a second aluminum alloy powder (hereinafter referred to as non-nitrided Al powder) that does not cause nitriding, or in a combination of the nitriding accelerative Al powder and a third aluminum alloy powder (hereinafter referred to as nitriding suppressive Al powder) that is capable of forcibly inhibiting nitriding, and then heating and sintering a green compressed powder compact obtained by molding the mixed powder in a nitrogen gas atmosphere controlled in a prescribed temperature range.

Also when no old grain boundaries clearly appear in the base of the powder aluminum alloy as shown in FIG. 5 or 6, AlN layers and layers consisting of a nitriding suppressive element are dispersed absolutely similarly to the AlN coating layers in the structure of the aluminum alloy having clearly appearing old grain boundaries as shown in FIG. 2, 3 or 4.

As to the conventional nitriding technique, the mechanism of nitriding has not been clearly worked out in detail and hence it has previously been impossible to implement the structure resulting from accelerating nitriding for forming AlN layers only on certain specific old grain boundaries while inhibiting nitriding so as not to form AlN layers in the remaining old grain boundaries as proposed by the present invention.

Therefore, the inventors have analyzed and investigated the reactive behavior of the elements in the vicinity of the extreme surfaces of raw material Al powder in the heating process, which has not heretofore been analyzed or investigated. Thereby as a result, the inventors have worked out the nitriding mechanism in the aluminum powder and have determined proper restrictions on the essential compositions related to the raw material aluminum alloy powder, as necessary for preparing a powder aluminum alloy having AlN coating layers partially existing on old grain boundaries as defined by the present invention.

The essential compositions of the nitriding accelerative Al powder, the non-nitrided Al powder and the nitriding suppressive Al powder serving as raw powder materials are as follows:

① Nitriding Accelerative Al Powder: nitriding accelerative element≧0.05%, nitriding suppressive element<0.01%, rest or remainder: Al ② Non-Nitrided Al Powder: nitriding accelerative element <0.05%, rest or remainder: Al ③ Nitriding Suppressive Al Powder: nitriding accelerative element≧0.05% nitriding suppressive element≧0.01%, rest or remainder: Al The above numerical values are expressed in terms of weight, while the nitriding accelerative element is an element selected from Mg, Ca an d Li and the nitriding suppressive element is a high vapor pressure element consisting of Sn, Pb, Sb, Bi or S as described above. The aluminum alloy powder serving as the raw material powder is generally prepared by atomization, so that oxygen (O) contained in the atomization atmosphere reacts with aluminum (Al) to form aluminum oxide ($Al_2O_3$) films on the grain surfaces. While it has been considered that the aluminum oxide films cover the Al grain surfaces and thus inhibit a reaction between nitrogen and aluminum to prevent the progress of nitriding, even if the aluminum alloy powder is heated in a nitrogen gas atmosphere, there has heretofore been no report clearly grasping this phenomenon. However, the inventors have noted that it is possible to carry out an elemental analysis on the extreme outer surfaces to a depth of about 0.5 nm (nanometers), i.e. in the extreme outer layer regions with a thickness of about 3 atomic layers of the aluminum alloy powder, and the reactive behavior of the elements can be directly analyzed by employing X-ray photoelectron spectroscopy (XPS) through synchrotron radiation (SR). The inventors clarified the mechanism of nitriding in the aluminum powder with such an analyzer (hereinafter referred to as an SR-XPS device), and thereby succeeded in defining and restricting the additional elements effective for breaking and/or decomposing the aluminum oxide films and accelerating or suppressing nitriding on the Al grain surfaces respectively.

The inventors have invented the nitriding accelerative Al powder, the non-nitrided Al powder and the nitriding suppressive Al powder on the basis of results obtained from the above analysis. The essential elements and the contents thereof in each powder and the functions and effects exerted on the formation or suppression of AlN coating layers are now described. While the following description particularly refers to Mg among the effective nitriding accelerative elements Mg, Ca and L, inventors have confirmed similar effects as to the remaining elements Ca and Li.

① Nitriding Accelerative Al Powder (method of forming AlN coating layers on old grain boundaries by nitriding)

Figure 7A:
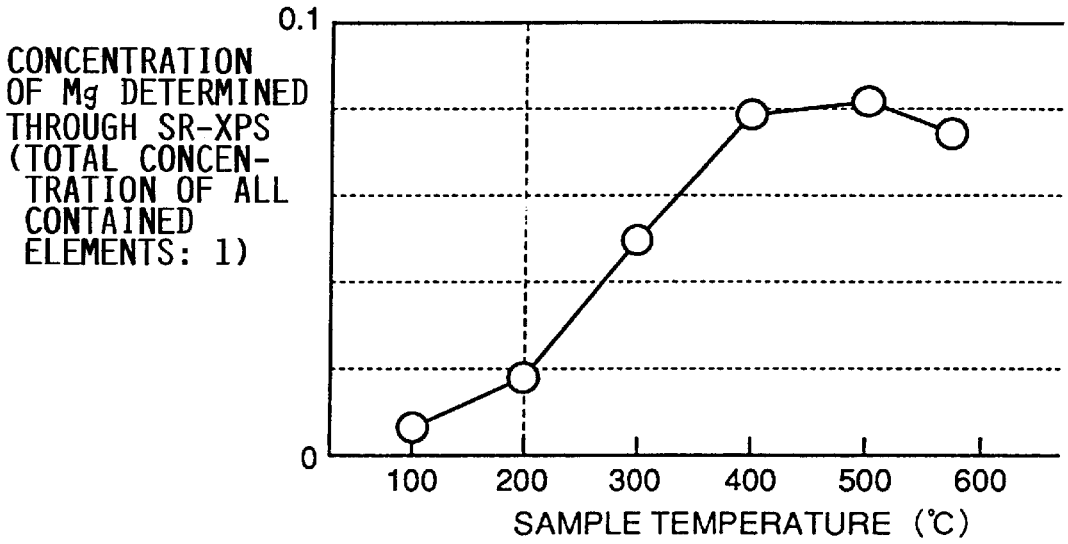
FIGS. 7A and 7B are graphs respectively illustrating results of composition analysis of starting material powders using SR-XPS.
Figure 7B:
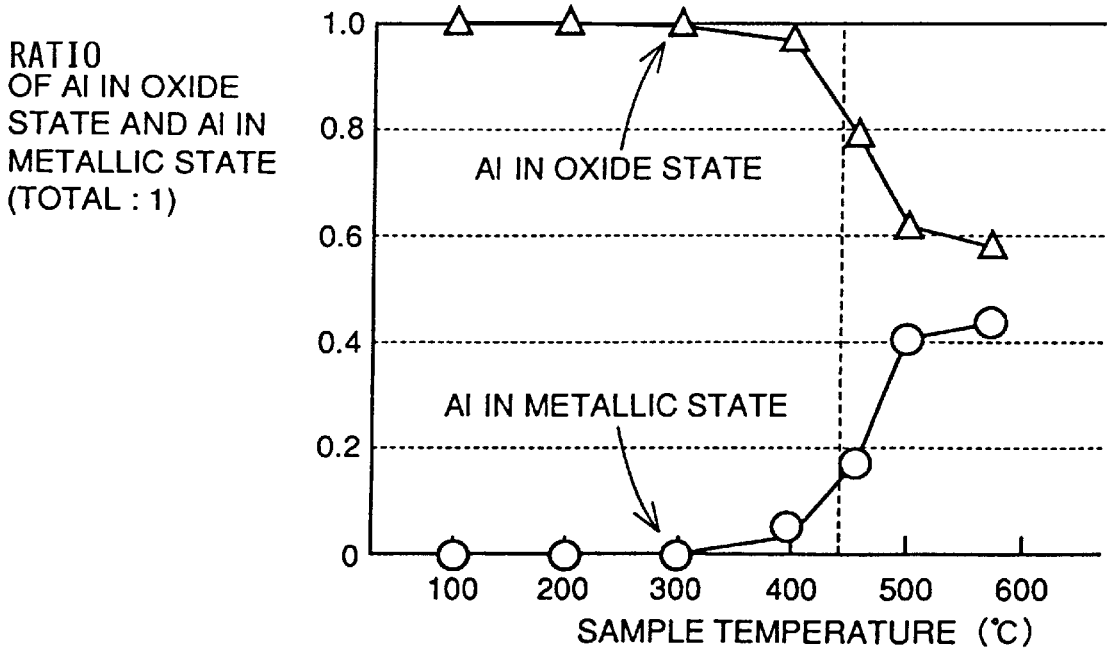
Figure 8A:
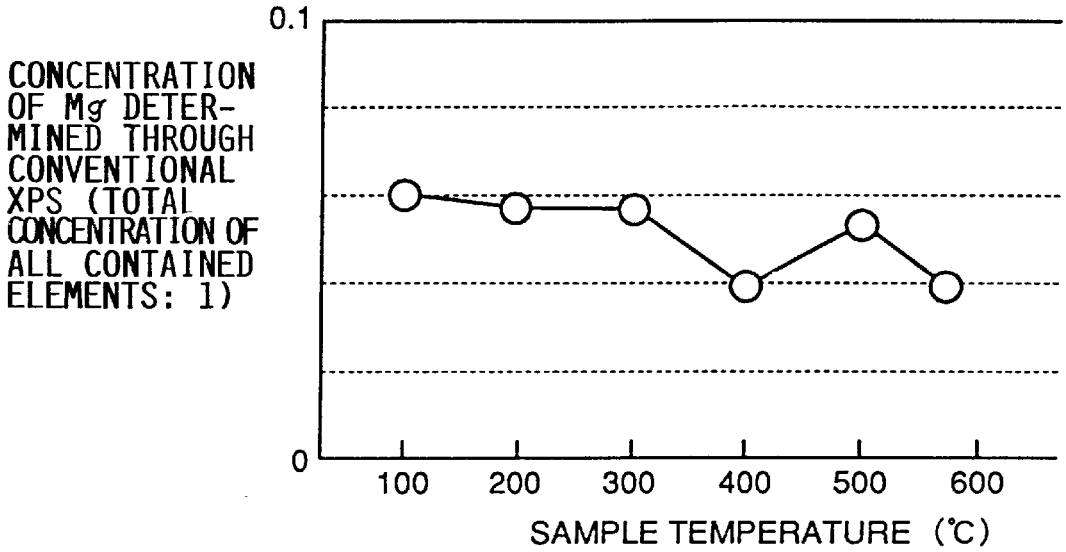
FIGS. 8A and 8B are graphs respectively illustrating results of composition analysis using conventional XPS.
Figure 8B:
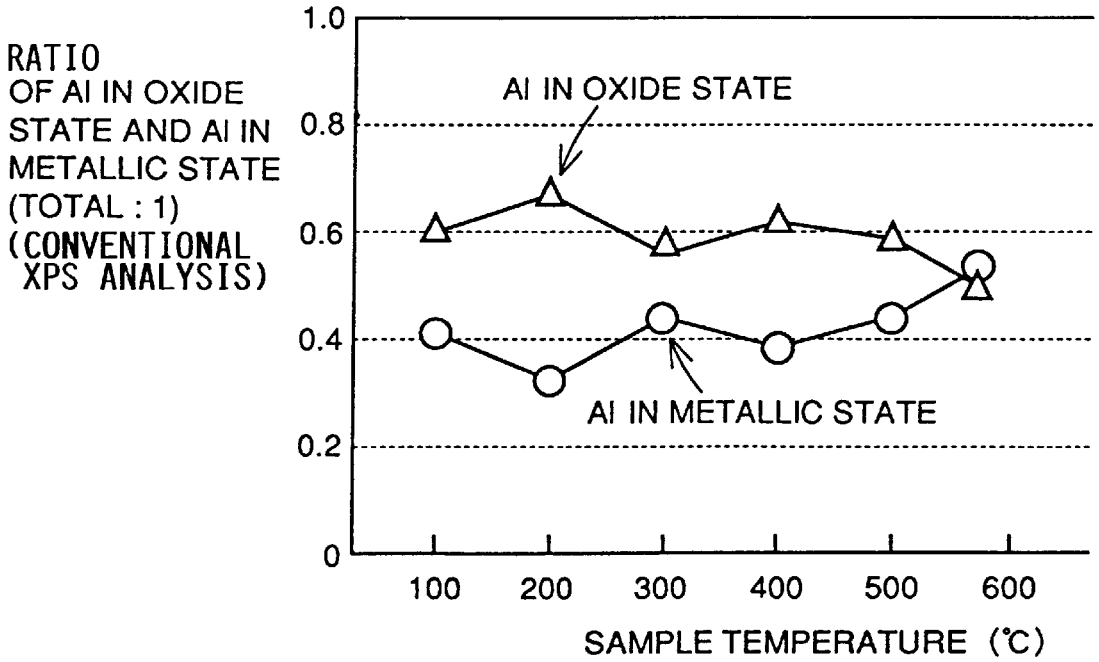

The inventors have used the SR-XPS device to continuously analyze the elemental behavior on grain surfaces of an Al powder containing Mg in an extremely small amount of at least 0.05 percent by weight, while heating the Al powder up from an ordinary room temperature in the range of 18° C. to 24° C. Thereby, the inventors determined or detected that the concentration of Mg starts to increase in the vicinity of the extreme surfaces of the grains when the temperature exceeds about 200° C. as shown in FIG. 7A. Following this, the inventors have confirmed that Al, which has been detected only as an oxide at ordinary room temperature, starts being detected not as an oxide but as metallic Al at a temperature level at and above about 450° C. for the first time. On the other hand, it is understood from FIG. 8A that a conventional XPS device cannot detect the aforementioned clear change of behavior. Namely, the inventors have succeeded in working out such a nitriding mechanism that, when heating Al powder containing at least 0.05 percent by weight of Mg in a nitrogen gas atmosphere, the Mg dispersed in the powder moves from the interior to the grain surfaces due to the high vapor pressure and strong affinity with oxygen contained in the aluminum oxide films formed on the grain surfaces, and the aluminum oxide films formed on the grain surfaces are decomposed by reduction of Mg when the temperature exceeds a level of about 450° C. to form metallic Al, which in turn reacts with nitrogen contained in the heating atmosphere to form AlN coating layers that do not contain impurity oxygen on the grain surfaces or grain boundaries. In this case, the content of the high vapor pressure element such as Sn must indispensably be less than 0.01 percent by weight, as described in the following item ③ for the nitriding suppressive Al powder. Namely, the inventors have clarified that an indispensable condition for the composition of the nitriding accelerative Al powder is that it must contain at least 0.05 percent by weight of Mg or other nitriding accelerative element and less than 0.01 percent by weight of the high vapor pressure element.

② Non-Nitrided Al Powder

Also as to an Al powder containing less than 0.05 percent by weight of Mg, the inventors have used the SR-XPS device to observe the reactive behavior on the grain surfaces in the process of heating the powder in a nitrogen gas atmosphere to confirm the presence of Al only in the state of an oxide bonded with oxygen, as confirmed in the aforementioned nitriding accelerative Al powder, while the absence of metallic Al and the absence of formation of AlN coating layers was also confirmed even if the powder was heated to about 450° C. Namely, the inventors have clarified that an indispensable condition for the composition of the non-nitrided Al powder causing no nitriding is that it must contain less than 0.05 percent by weight of Mg.

③ Nitriding Suppressive Al Powder

Also as to an Al alloy powder containing at least 0.01 percent by weight of Sn, which is one of high vapor pressure elements having the effect of suppressing nitriding, and at least 0.05 percent by weight of Mg, the inventors have used the SR-XPS device to observe the reactive behavior on grain surfaces in the process of heating the powder in a nitrogen gas atmosphere to confirm the presence of Al in the state of an oxide bonded with oxygen, as confirmed in relation to the aforementioned nitriding accelerative Al powder, while also confirming that the concentration of Mg started to increase in the vicinity of the extreme surfaces of the grains when the temperature exceeded about 200° C. and Sn was detected inside concentrated layers of Mg in the vicinity of the grain surfaces, i.e. central sides of the grains, when the powder was heated to about 250° C. The inventors have confirmed such a phenomenon that Al of the oxide state was reduced when the Al alloy powder was heated to 450° C. since aluminum oxide films formed on the grain surfaces were decomposed by reduction of Mg as described above, while metallic Sn was simultaneously detected on the grain surfaces, and the inventors have confirmed that the overall grain surfaces were covered with Sn. In this case, the absence of formation of AlN coating layers on the grain surfaces of the Al alloy powder was confirmed.

The inventors have investigated this phenomenon in further detail, to understand that Sn covered the grain surfaces and thus prevented formation of AlN coating layers through the following process. When a high vapor pressure element such as Sn is forcibly introduced into Al alloy powder by rapid solidification, the Sn is not solidly dissolved in Al and does not form a compound with Al, but instead the Sn is dispersed in the powder base simply in a metallic state. Sn has a low melting point (liquid phase generating temperature) of about 232° C., and moves from the interior of the Al alloy powder to the energetically stable grain surfaces in an initial stage (about 250° C.) of the temperature rise process. However, the grain surfaces are covered with the aluminum oxide films and are provided with the Mg concentrated layers moving to the vicinity of the extreme surfaces of the grains in the stage of about 200° C., and hence Sn cannot flow out to the grain surfaces. When the temperature exceeds 450° C., however metallic Sn flows out through cracks of the aluminum oxide films decomposed by reduction of Mg to cover the grain surfaces, thereby preventing reaction between the nitrogen gas contained in the atmosphere and Al contained in the Al alloy powder. Thus, no AlN coating layers can be formed.

Namely, the inventors have found out that nitriding can be suppressed when the Al alloy powder contains at least 0.01 percent by weight of Sn and at least 0.05 percent by weight of Mg. In other words, the inventors have clarified that an indispensable condition for the composition of the nitriding suppressive Al powder is that the contents of Mg and Sn satisfy Mg≧0.05 percent by weight and Sn≧0.01 percent by weight respectively in the Al alloy powder.

Also as to an Al alloy powder containing Sn, which is one of the high vapor pressure elements, in a suppressed amount of 0.005 percent by weight while containing at least 0.05 percent by weight of Mg, the inventors have used the SR-XPS device to observe the reactive behavior on grain surfaces in the process of heating the powder in a nitrogen gas atmosphere for verifying the aforementioned process, to confirm that it is difficult to utilize this powder as a nitriding suppressive Al powder that completely suppresses nitriding since the powder contained Sn in such a small amount of 0.005 percent by weight that the overall powder grains could not be completely covered with Sn and nitriding took place to form AlN coating layers in parts of the grain surfaces although metallic Sn was detected in partial cracks due to breaking of aluminum oxide coating layers at a temperature of about 450° C.

The inventors have also confirmed that elements such as Pb, Sb, Bi and S also have functions and effects similar to those of Sn. While any of these high vapor pressure elements is forcibly introduced into the Al alloy powder by rapid solidification atomization as hereinabove described, it is difficult to homogeneously disperse the high vapor pressure element in the Al powder if the solidification rate (degree of quenching) is less than 100° C./sec. In order to introduce the high vapor pressure element, therefore, it is indispensable to employ rapidly solidified Al powder having a solidification rate (degree of quenching) of at least 100° C./sec.

The powder aluminum alloy having a structure in which Al coating layers are formed only on certain old grain boundaries or old grain surfaces while old grains are bonded to each other at the remaining old grain boundaries where no AlN coating layers are formed, as shown in the model diagram of FIG. 2, 3 or 4, with employment of the aforementioned nitriding accelerative Al powder, non-nitrided Al powder and nitriding suppressive Al powder, and a method of preparing the same, will now be described.

The procedure of the following method of preparing the powder aluminum alloy also applies to preparation of an aluminum alloy having a structure in which old grain boundaries are not clearly apparent but AlN layers are discontinuously dispersed in the base as shown in the model diagram of FIG. 5 or 6.

The structural feature of the powder aluminum alloy having the structure shown in FIG. 2 and a method of preparing the same are now described. The structural feature of this powder aluminum alloy resides in that AlN coating layers are present along only parts of old grain boundaries of the aluminum alloy powder forming the base of the aluminum alloy sintered body that was obtained by compression molding the aluminum alloy powder and heating and sintering the compact in an atmosphere containing nitrogen gas. Namely, old aluminum alloy grains enclosed with AlN coating layers and such grains not enclosed with AlN coating layers are mixed with each other, and the AlN coating layers are discontinuously dispersed in the overall base of the sintered aluminum alloy. The AlN coating layers existing on certain old grain boundaries are formed by reaction of nitrogen gas contained in the atmosphere and aluminum (Al) contained in the raw material powder during the heating and sintering process, while the old grains are strongly bonded with each other by diffusion and sintering at the remaining old grain boundaries that are not provided with AlN coating layers. Consequently, two effects, i.e. improvement of wear resistance of the powder aluminum alloy due to presence of the AlN coating layers and improvement of toughness of the powder aluminum alloy due to strong bonding between the old grains, can be simultaneously attained.

The inventors have made various experiments and analyses, to determine that a method of compression-molding aluminum alloy powder containing the aforementioned nitriding accelerative Al powder and non-nitrided Al powder blended in a prescribed ratio and thereafter heating and sintering the compact in an atmosphere containing nitrogen gas is effective for partially forming and dispersing AlN coating layers by direct nitriding in the aluminum sintered body as described above. The essential compositions of the nitriding accelerative Al powder and the non-nitrided Al powder are as follows.

Nitriding Accelerative Al Powder: nitriding accelerative element≧0.05%, high vapor pressure element<0.01%, rest: Al Non-Nitrided Al Powder: nitriding accelerative element<0.05%, rest: Al The above numerical values are expressed in terms of weight, while the nitriding accelerative element is an element selected from Mg, Ca and Li and the high vapor pressure element is Sn, Pb, Sb, Bi or S as described above. While the following description is with reference to Mg among Mg, Ca and Li, which are each effective as nitriding accelerative elements, the inventors have confirmed similar effects as to the remaining elements Ca and Li.

As hereinabove described, Mg contained in the nitriding accelerative Al powder breaks and decomposes aluminum oxide ($Al_2O_3$) films covering the grain surfaces by reduction caused at a temperature of about 450° C., whereby Al contained in the powder directly reacts with nitrogen (N) contained in the sintering atmosphere to form AlN coating film layers on the grain surfaces (old grain boundaries or old grain surfaces in the sintered body). The Mg content necessary for causing such reduction is at least 0.05% in terms of weight, while the content of the high vapor pressure element such as Sn, Pb, Sb, Bi or S must be suppressed to less than 0.01%, as described later in detail.

If the Mg content in the powder is less than 0.05%, aluminum oxide films cover the grain surfaces since reduction is not caused and nitrogen contained in the sintering atmosphere cannot directly react with the Al contained in the powder, and hence no AlN coating layers can be formed even if the powder is heated and sintered in the prescribed temperature range. This is the feature of the non-nitrided Al powder. However, sintering by diffusion progresses between the grains since no AlN coating layers were formed, whereby the grains can be strongly bonded with each other. Thus, the powder aluminum alloy having partially formed and dispersed AlN coating layers shown in FIG. 2 is characterized in that the Mg content is at least 0.05% and the content of the high vapor pressure element is less than 0.01% in the old aluminum alloy grains enclosed with AlN coating layers, while the Mg content is less than 0.05% in the old aluminum alloy grains not enclosed with AlN coating layers.

Furthermore, the inventors have also found out that the blending ratio of the nitriding accelerative Al powder relative to the non-nitrided Al powder is another important factor for obtaining the AlN dispersed powder aluminum alloy having the aforementioned structure. In case of preparing an aluminum sintered body by nitriding only by means of the nitriding accelerative Al powder as described above, AlN coating layers are formed on all old grain boundaries and coupled with each other to provide a structure identical to that of the AlN dispersed powder aluminum alloy obtained by the prior art, and the AlN coating layers inhibit metallic bonding (sintering) between the grains, to remarkably reduce the toughness of the resulting powder aluminum alloy. Namely, the inventors have noted that AlN coating layers formed on the old grain boundaries in a coupled state inhibit the bonding between the old grains, and the inventors carried out experiments and analyses, to determine that bonding between old grains is sufficiently attained so as not to reduce the toughness of the powder aluminum alloy, by using the non-nitrided Al powder, when the ratio of the nitriding accelerative Al powder relative to the overall mixed powder (including the nitriding accelerative Al powder and the non-nitrided Al powder) is not more than 90% in terms of weight. The inventors have also confirmed that the toughness of the aluminum alloy is reduced if the content of the nitriding accelerative Al powder is in excess of 90%.

The structural feature of the powder aluminum alloy having the structure shown in FIG. 3 or 4 and a method of preparing the same will now be described. As hereinabove described, the structural feature of this powder aluminum alloy resides in that AlN coating layers and coating layers of a high vapor pressure element are mixed along only certain old aluminum alloy grain boundaries of the aluminum alloy powder forming the base of the aluminum alloy sintered body that was obtained by compression-molding the aluminum alloy powder and heating and sintering the same in an atmosphere containing nitrogen gas, partial old grains or some old grains are enclosed with a high vapor pressure element, and AlN coating layers are discontinuously dispersed in the overall base of the sintered aluminum alloy. While the AlN coating layers existing along the certain old grain boundaries are formed by reaction between nitrogen gas contained in the atmosphere and aluminum (Al) contained in the raw material powder during the heating and sintering process, and the coating layers of the high vapor pressure element such as Sn, Pb, Sb, Bi or S are present along the old grain boundaries that are not provided with AlN coating layers. The coating layers of the high vapor pressure element do not inhibit diffusion between the old aluminum alloy grains, and hence the old grains are strongly bonded with each other by sintering. Consequently, two effects, i.e. improvement of wear resistance of the powder aluminum alloy due to presence of the AlN coating layers and improvement of the toughness of the powder aluminum alloy due to strong bonding between the old grains, can be simultaneously attained.

When the green compact of the mixed powder of the nitriding accelerative Al powder and the nitriding suppressive Al powder is heated and sintered in the atmosphere containing nitrogen gas, however, both the AlN coating layers and the coating layers of the high vapor pressure element are mixed in the same old grain boundaries in some regions, where the nitriding accelerative Al powder and the nitriding suppressive Al powder are in contact with each other. The structural feature in this case will be described later in detail.

The inventors have carried out various experiments and analyses, to determine that a method of compression-molding aluminum alloy powder obtained by blending the aforementioned nitriding accelerative Al powder and nitriding suppressive Al powder in a prescribed ratio and then heating and sintering the green compact in an atmosphere containing nitrogen gas is effective for partially forming and dispersing AlN coating layers in the aluminum sintered body by direct nitriding. The essential compositions of the nitriding accelerative Al powder and the nitriding suppressive Al powder are as follows.

Nitriding Accelerative Al Powder: nitriding accelerative element$\geqq$0.05%, high vapor pressure element<0.01%, rest: Al Nitriding Suppressive Al Powder: nitriding accelerative element$\geqq$0.05%, high vapor pressure element$\geqq$0.01%, rest: Al The above numerical values are expressed in terms of weight, while the nitriding accelerative element is an element selected from Mg, Ca and Li and the high vapor pressure element is Sn, Pb, Sb, Bi or S as described above. While the following description is with reference to Mg among Mg, Ca and Li, which are all effective as nitriding accelerative elements, the inventors have confirmed similar effects as to the remaining elements Ca and Li.

While the mixed powder consisting of the nitriding accelerative Al powder and the nitriding suppressive Al powder is employed as the raw material powder in the present invention, the function of the nitriding accelerative Al powder has already been described above, and the function of the nitriding suppressive Al powder and the feature of the AlN dispersed powder aluminum alloy prepared from the powder will now be described. The feature of the nitriding suppressive Al powder resides in that the high vapor pressure element such as Sn, Pb, Sb, Bi or S covers the old aluminum grain boundaries or old aluminum grain surfaces in the heating and sintering process thereby inhibiting direct reaction between Al contained in the powder base and nitrogen (N) contained in the atmosphere. Sn, which is one of the high vapor pressure elements, however, cannot break or decompose aluminum oxide films by reduction as Mg does, judging from its ionization tendency. Thus, Sn cannot singly cover the old grain boundaries or old grain surfaces to suppress nitriding. As understood from the aforementioned results of the SR-XPS analysis, however, the high vapor pressure element such as Sn, Pb, Sb, Bi or S does not form a compound with Al contained in the powder base, has a higher diffusion rate than Mg in Al, and forms a liquid phase or a vapor phase in a temperature range lower than the nitriding starting temperature (around 450° C.). Thus, the inventors have considered that the reaction between the nitrogen gas contained in the atmosphere and Al contained in the base can be suppressed by introducing a prescribed amount of Mg into the aluminum powder and heating and sintering the same thereby causing reduction by Mg and breaking and decomposing aluminum oxide films so that a liquid or vapor phase of the high vapor pressure element thereafter flows out from cracks or breaks in the aluminum powder to cover the old grain boundaries or old grain surfaces, and the toughness of the powder aluminum alloy can be improved by improving the bonding ability between the grains on the old grain boundaries or old grain surfaces.

The inventors have repeated various experiments and analyses, to determine that the Mg content must be at least 0.05% in terms of weight in order to decompose the aluminum oxide films on the grain surfaces as hereinabove described while the content of the high vapor pressure element must be at least 0.01% in the powder so that the high vapor pressure element flows out on the grain surfaces for covering the old grain surfaces after Mg breaks the oxide films by reduction, thereby inhibiting reaction between the nitrogen gas (N) and aluminum (Al) contained in the base, suppressing formation of AlN coating layers and improving bonding between the grains. If the content of the high vapor pressure element in the aluminum powder is less than 0.01%, the high vapor pressure element cannot completely cover the old grain boundaries or surfaces but allows formation of AlN coating layers, and this alloy composition coincides with that of the aforementioned nitriding accelerative Al powder. On the other hand, the inventors have also found out by experiments or the like that the upper limit of the content of the high vapor pressure element is restricted. While the high vapor pressure element flows out from the powder to the surfaces through the broken or decomposed aluminum oxide surface films as described above and thereafter exists on the old grain boundaries or old grain surfaces as coating layers, such coating layers define starting points of cracks when external force is applied to the aluminum alloy to reduce the strength and toughness of the powder aluminum alloy if the amount of dispersion is excessive. The inventors have carried out experiments and studies in consideration of this point, to determine that the upper limit of the content of the high vapor pressure element in the nitriding suppressive Al powder is 2% in terms of weight. If the raw material powder is prepared from powder containing the high vapor pressure element in excess of 2%, the strength and toughness of the powder aluminum alloy are extremely reduced.

Therefore, the powder aluminum alloy having partially formed and dispersed AlN coating layers as shown in FIG. 3 or 4 is characterized in that the Mg content is at least 0.05% and the content of the high vapor pressure element is less than 0.01% in the old aluminum alloy grains enclosed with the AlN coating layers while the Mg content is at least 0.05% and the content of the high vapor pressure element is at least 0.01% and not more than 2% in the old aluminum alloy grains enclosed with the high vapor pressure element coating layers.

The inventors have also found out that the blending ratio of the nitriding accelerative Al powder relative to the nitriding suppressive Al powder which together form the raw material powder, is also an important factor for obtaining the AlN dispersed powder aluminum alloy having the aforementioned structure. When an aluminum sintered body is prepared from only the nitriding accelerative Al powder by nitriding as described above similarly to the AlN dispersed powder aluminum alloy shown in FIG. 2, AlN coating layers are formed on all old grain boundaries in a coupled state to provide a structure identical to that of the AlN dispersed powder aluminum alloy obtained by the prior art, and hence the AlN coating layers inhibit bonding between the grains to extremely reduce the toughness of the powder aluminum alloy. Namely, the inventors have noted that coupled AlN coating layers inhibit the bonding ability between the old grains and have carried out experiments and analyses, to determine that sufficient bonding ability is attained between old grains by the nitriding suppressive Al powder without reducing the toughness of the powder aluminum alloy when the ratio of the nitriding accelerative Al powder relative to the overall mixed powder containing the nitriding accelerative Al powder and the non-nitrided Al powder is not more than 90% in terms of weight. The inventors have also confirmed that the toughness of the aluminum alloy is reduced if the content of the nitriding accelerative Al powder is in excess of 90%.

While the respective two combinations of (1) nitriding accelerative Al powder and non-nitrided Al powder, and (2) nitriding accelerative Al powder and nitriding suppressive Al powder have been described above in relation to the raw material powder necessary for preparing the powder aluminum alloy having the structure according to the invention, the target structure can be attained also by combining (1) and (2) with each other, as a matter of course. When a mixed powder obtained by blending three types of aluminum alloy powder, i.e. nitriding accelerative Al powder, non-nitrided Al powder and nitriding suppressive Al powder in prescribed ratios, is compression-molded and heated and sintered, an AlN dispersed powder aluminum alloy having a structure in which AlN coating layers are present on certain old grain boundaries or old grain surfaces and grains are metallically bonded (sintered) with each other in the remaining old grain boundaries is obtained as shown in FIG. 9.

Figure 9:
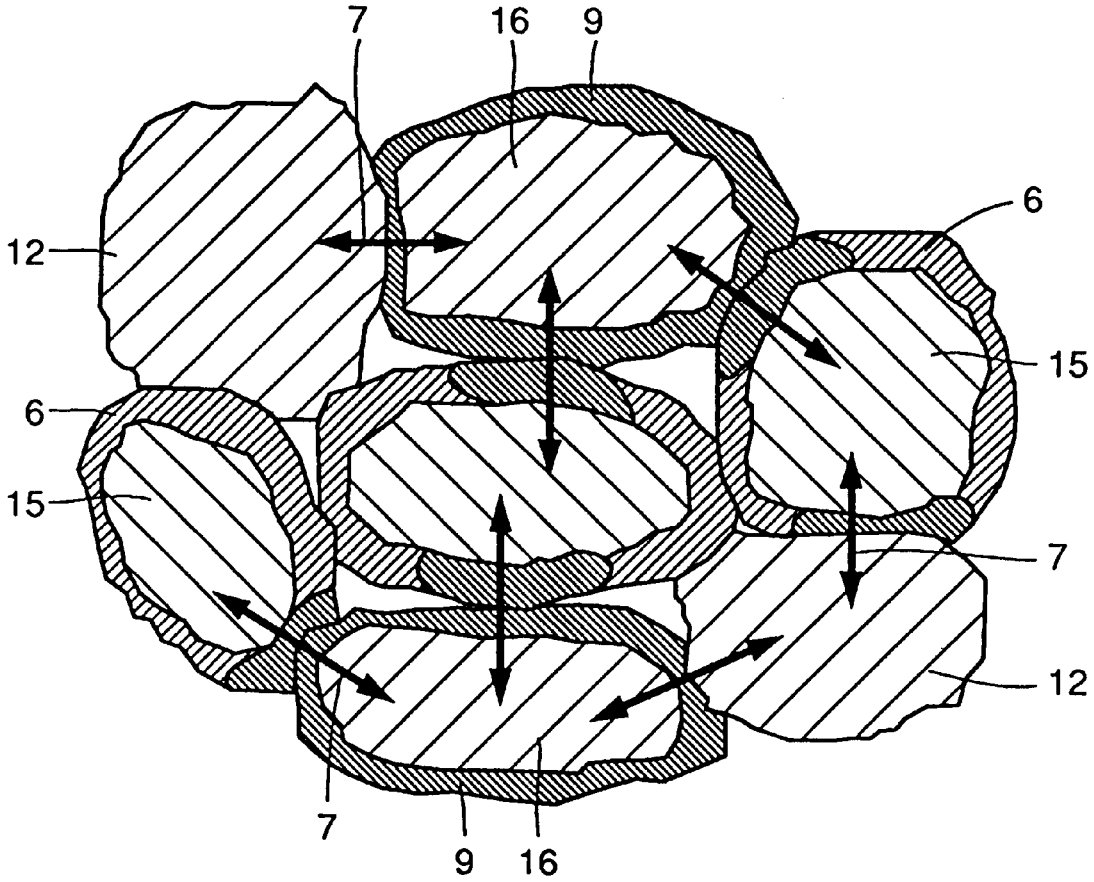
FIG. 9 is a schematic cross-section typically illustrating a further exemplary structure of the AlN dispersed powder aluminum alloy according to the present invention.

Referring to FIG. 9, AlN coating layers 6 are mainly formed on nitriding accelerative Al grains 15. Coating layers 9 mainly consisting of a nitriding suppressive element are formed on nitriding suppressive Al grains 16. No coating layers are formed on non-nitrided grains 12. Arrows 7 indicate progress of diffusion and sintering between grains. The ratio of the nitriding accelerative Al powder to the overall raw material powder is preferably not more than 90% in terms of weight, similarly to the aforementioned case. If the content of the nitriding accelerative Al powder exceeds 90%, the ratio of the old grain boundaries provided with the AlN coating layers is increased and that of the metallically bonded (sintered) old grain boundaries is reduced in the overall powder aluminum alloy, to disadvantageously reduce the toughness of the aluminum alloy.

The maximum thickness of the aluminum nitride (AlN) coating layers formed and dispersed in the inventive aluminum alloy is desirably not more than 3 μm. If the maximum thickness of the AlN coating layers exceeds 3 μm, stress concentrates in the portions provided with the AlN coating layers to define starting points of cracks when external force is applied to the aluminum alloy, which extremely reduces the strength, and particularly the fatigue strength of the aluminum alloy. In the present invention, therefore, the maximum thickness of the AlN coating layers formed by direct nitriding is preferably not more than 3 μm, and more preferably not more than 2 μm. The thickness of the AlN coating layers can be controlled by the heating holding time in the nitriding, and the density (porosity) of the green powder compact.

The features of the nitriding accelerative Al powder, the non-nitrided Al powder and the nitriding suppressive Al powder forming the raw material powder are now described. While each aluminum alloy powder is prepared by rapid solidification such as atomization, the solidification rate (degree of quenching) must be at least 100° C./sec. since a prescribed amount of Mg and a high vapor pressure element must be introduced into the powder. If the solidification rate for the powder is less than 100° C./sec., the prescribed amount of Mg and/or the high vapor pressure element defined by the present invention cannot be introduced into the powder and the inventive AlN dispersed powder aluminum alloy cannot be prepared.

It is possible to add an element other than or in addition to the nitriding accelerative element consisting of Mg, Ca or Li and the nitriding suppressive element, i.e., the high vapor pressure element such as Sn, Pb, Sb, Bi or S to the aluminum alloy powder employed in the present invention. In order to improve the wear resistance or heat resistance of the alloy, for example, it is possible to add at least one element selected from the group of Si, Fe, Ni, Cr, V, Ti, Cu, Zr, Mn, Mo, Zn and the like as needed. Particularly when Si, which has an effect of promoting formation of AlN coating layers, is introduced into the nitriding accelerative Al powder in an amount of at least 1%, the AlN coating layers can be readily formed in the sintering process.

The minimum grain diameter of the aluminum alloy powder forming the raw material powder is preferably at least 15 μm. If the aluminum alloy powder contains a large amount of grains of less than 15 μm in grain diameter, there is a possibility of causing a problem such as density dispersion of the green powder compact or cracking in the compact due to reduction of powder flowability. Further, the specific surface areas of alumina films covering the surfaces of the aluminum alloy grains forming the raw material powder would be increased and would thus inhibit nitriding, and hence the time required for nitriding would be increased to cause a problem in economy.

The method of preparing an aluminum alloy according to the present invention is now described.

① True Density Ratio of Green Powder Compact

Pores, holes or voids in the green powder compact define passages for the nitrogen gas flowing in the green compact for promotion of nitriding. Thus, it is an indispensable condition that the green compact possesses a proper amount of pores therein. Tn more concrete terms, the true density ratio of the green compact must be not more than 85% the true density ratio exceeds 85%, the nitrogen gas cannot homogeneously flow into the green compact which would result in heterogeneous progress of nitriding, leading to dispersion in the amount of AlN formed in the sintered body. If the true density ratio exceeds 95%, the nitrogen gas cannot flow into the green compact and hence no AlN can be formed in the alloy. If the true density ratio falls below 50%, on the other hand, the strength of the green compact is so reduced that the green compact is likely to be chipped during transportation or the like. In the present invention, therefore, the true density ratio of the powder green compact is preferably at least 50% and not more than 85%.

② Heating Temperature in Nitriding

As hereinabove described, it is indispensable to promote diffusion of Mg in the aluminum alloy powder and breaking of surface oxide films in the powder by reduction of Mg in order to prepare the inventive aluminum alloy. The oxide films are broken to expose aluminum contained in the base, which in turn reacts with the nitrogen gas to form AlN coating layers. The inventors have carried out a study on the basis of the aforementioned results of SR-XPS, to determine that the proper heating temperature range for promoting nitriding is at least 450° C. and not more than 570° C. If the heating temperature is less than 450° C., nitriding progresses so insufficiently that an aluminum alloy having the target structure cannot be obtained. If the heating temperature exceeds 570° C., on the other hand, the alloy element added to the powder is coarsened. Thus, the proper range of the heating temperature for nitriding is at least 450° C. and not more than 570° C. in the present invention, and more preferably, the heating temperature range for nitriding is 520° C. to 550° C., in order to promote the nitriding speed for forming a larger amount of AlN coating layers in particular. The heating time, which is correlated with the amount of formation of AlN, is controlled in response to the target AlN formation amount in the present invention.

③ Hot Plastic Working of Nitrided Body

In order to improve the mechanical properties of the sintered body containing a proper amount of AlN coating layers homogeneously formed and dispersed by nitriding, it is effective to reduce the amount of holes or pores in the sintered body by performing hot plastic working such as hot forging or hot extrusion. In more concrete terms, the true density ratio of the finished alloy is set in excess of 97% for converting substantially all holes to closed pores. For this purpose, it is effective to solidify the sintered body by heating it to at least 400° C. and applying a surface pressure of at least 6 t/cm$^2$ in hot forging or an extrusion ratio of at least 6 in hot extrusion. If this condition is not satisfied, it is difficult to obtain an aluminum alloy having a true density ratio of at least 97% (porosity of not more than 3%). It is also one of the indispensable conditions that the upper limit of the heating temperature for the sintered body after nitriding is the nitriding temperature. If the sintered body is heated to a level exceeding the nitriding temperature, there is a possibility that the nitriding further progresses and thus changes the AlN formation amount, and hence the re-heating temperature for the sintered body is preferably not more than the nitriding (sintering) temperature.

EXAMPLE 1

TABLE 1

Inventive Sample: Nos. 1 to 4, Comparative Sample: Nos. 5 & 6

| Sample | Powder Blending Ratio (%) | | Tensile Strength | Elongation | AlN Content | Structural State of |
|---|---|---|---|---|---|---|
| No. | Powder① | Powder② | (kgf/mm②) | (%) | (%) | Alloy |
| 1 | 85 | 15 | 41.7 | 1.0 | 8.8 | (B) |
| 2 | 70 | 30 | 43.3 | 1.4 | 7.4 | (B) |

TABLE 1-continued

Inventive Sample: Nos. 1 to 4, Comparative Sample: Nos. 5 & 6

| Sample No. | Powder Blending Ratio (%) Powder① | Powder② | Tensile Strength (kgf/mm②) | Elongation (%) | AlN Content (%) | Structural State of Alloy |
|---|---|---|---|---|---|---|
| 3 | 50 | 50 | 40.1 | 1.8 | 5.7 | (B) |
| 4 | 30 | 70 | 38.5 | 2.0 | 4.2 | (B) |
| 5 | 100 | 0 | 39.5 | 0.1 | 11.4 | (A) |
| 6 | 95 | 5 | 39.5 | 0.2 | 10.2 | (A) |

Powder Composition (in terms of weight)
Powder①; Al-15% Si-0.89% Mg (d av: 65 μm; d min: 22 μm)
Powder②; Al-15% Si-0.02% Mg (d av: 72 μm; d min: 25 μm)
d av: mean grain diameter; d min: minimum grain diameter Samples Nos. 1 to 6 of aluminum alloy powder were prepared in blending ratios shown in Table 1, molded into green compacts (relative density ratio: 65 to 70%) of 10 by 30 by 10 mm, which were held at a heating temperature of 550° C. for six hours in a heating furnace supplied with nitrogen gas at a flow rate of 3 1/min., and thereafter cooled to ordinary room temperature in a nitrogen atmosphere. The obtained sintered bodies were hot-forged to have a porosity of not more than 3%, and thereafter tensile test pieces were prepared from these samples and subjected to measurement of tensile strength and elongation and structural observation with an optical microscope. Further, the nitrogen gas contents of the sample pieces were quantitatively analyzed for calculating the AlN contents (percent by weight) in the powder aluminum alloys. Table 1 shows the results.

Referring to Table 1, the powder ① and the powder ② are nitriding accelerative Al powder and non-nitrided Al powder respectively, and Table 1 describes the blending ratios thereof in percent by weight. As to the results of the structural observation, (A) indicates a state in which all old grain boundaries are enclosed with AlN coating layers as shown in FIG. 1 while (B) indicates a state in which AlN coating layers are dispersed on some grains while the remaining old aluminum grains are sintered to each other as shown in FIG. 2 or AlN layers are discontinuously dispersed in the base of the aluminum alloy as shown in FIG. 5.

As understood from Table 1, the comparative samples Nos. 5 and 6 prepared by the conventional nitriding exhibited small elongation of about 0.1 to 0.2%, while the elongation was improved to exceed 1% in the samples Nos. 1 to 4 satisfying the conditions defined by the present invention. Further, it has also been confirmed from the results of the structural observation with the optical microscope that all old aluminum grain surfaces or grain boundaries were enclosed with AlN coating layers in the comparative samples Nos. 5 and 6 while AlN coating layers were dispersed in partial old grain boundaries and grains were sintered to each other in the remaining grain boundaries or AlN layers were discontinuously dispersed in the inventive samples Nos. 1 to 4. As hereinabove described, it is possible to form and disperse AlN coating layers in the aluminum alloy according to the present invention without reducing and in fact even improving the toughness (elongation) of the alloy.

EXAMPLE 2

TABLE 2

Inventive Sample: Nos. 1 to 7, Comparative Sample Nos. 8 to 10

| Sample No. | Powder Blending Ratio (%) Powder① | Powder② | Tensile Strength (kgf/mm②) | Elongation (%) | AlN Content (%) | Structural State of Alloy |
|---|---|---|---|---|---|---|
| 1 | 85 | 15(②- 1) | 44.5 | 1.2 | 6.7 | (B) |
| 2 | 65 | 35(②- 1) | 43.4 | 1.6 | 4.9 | (B) |
| 3 | 40 | 60(②- 1) | 41.0 | 1.9 | 3.1 | (B) |
| 4 | 85 | 15(②- 2) | 42.7 | 1.1 | 6.3 | (B) |
| 5 | 85 | 15(②- 3) | 40.3 | 1.0 | 6.4 | (B) |
| 6 | 85 | 15(②- 4) | 41.5 | 1.1 | 6.7 | (B) |
| 7 | 85 | 15(②- 5) | 42.6 | 1.1 | 6.0 | (B) |
| 8 | 100 | 0 | 40.6 | 0.2 | 8.6 | (A) |
| 9 | 95 | 5(③- 1) | 38.8 | 0.3 | 7.9 | (A) |
| 10 | 80 | 20(②- 6) | 33.2 | 0.2 | 5.9 | (B) |

Powder Composition (in terms of weight)
Powder①: Al-4% Fe-4% Ni-0.75% Mg (d av: 78 μm; d min: 20 μm)
Powder②-1: Al-4% Fe-4% Ni-0.33% Mg-0.64% Sn (d av: 72 μm; d min: 25 μm)
Powder②-2: Al-4% Fe-4% Ni-0.25% Mg-0.51% Pb (d av: 75 μm; d min: 20 μm)
Powder②-3: Al-4% Fe-4% Ni-0.50% Mg-0.72% Bi (d av: 69 μm; d min: 20 μm)
Powder②-4: Al-4% Fe-4% Ni-0.32% Mg-0.55% Sb (d av: 70 μm; d min: 25 μm)
Powder②-5: Al-4% Fe-4% Ni-0.53% Mg-1.15% S (d av: 75 μm; d min: 20 μm)
Powder②-6: Al-4% Fe-4% Ni-0.50% Mg-2.85% Sn (d av: 72 μm; d min: 25 μm)
d av: mean grain diameter; d min: minimum grain diameter Samples Nos. 1 to 10 of aluminum alloy powder were prepared by mixing materials in blending ratios shown in Table 2 and molded into green compacts (relative density ratio: 65 to 70%) of 10 by 30 by 10 mm, which in turn were held at a heating temperature of 550° C. for six hours in a heating furnace supplied with nitrogen gas at a flow rate of 3 1/min. and thereafter cooled to ordinary room temperature in a nitrogen atmosphere. The obtained sintered bodies were hot-forged to have a porosity of not more than 3%, and tensile test pieces were prepared from these aluminum alloy samples and be subjected to measurement of tensile strength and elongation and structural observation with an optical microscope. Further, the nitrogen gas contents of the respective sample test pieces were quantitatively analyzed for calculating AlN amounts (percent by weight) contained in the powder aluminum alloy samples. Table 2 shows the results.

Referring to Table 2, powder ① and powder ② are nitriding accelerative Al powder and nitriding suppressive Al powder respectively, and Table 2 describes the blending ratios in percent by weight. The lower part of Table 2 shows the different specific compositions of the powder ②. As to the results of the structural observation, (A) indicates a state in which all old grain boundaries are enclosed with AlN coating layers as shown in FIG. 1 while (B) indicates a state in which coating layers of a high vapor pressure element consisting of one of Sn, Pb, Sb, Bi and S are present simultaneously with old grain boundaries having AlN coating layers dispersed therein and in which the old aluminum grains are sintered in the areas of the high vapor pressure element coating layers as shown in FIG. 3, or the aluminum alloy base is formed by regions where AlN layers are dispersed and regions provided with layers consisting of a high vapor pressure element such as Sn, Pb, Sb, Bi or S, which is the nitriding suppressive element, as shown in FIG. 6.

As understood from Table 2, the comparative samples Nos. 8 and 9 prepared by the conventional nitriding exhibited a small elongation of about 0.2 to 0.3%, while the elongation was improved to values exceeding 1% in the samples Nos. 1 to 7 satisfying the conditions defined in the present invention. It has also been confirmed from the results of the structural observation with the optical microscope that all old aluminum grain surfaces or grain boundaries were enclosed with AlN coating layers in the comparative samples Nos. 8 and 9, while AlN coating layers were dispersed in partial old grain boundaries and grains were sintered in the remaining grain boundaries or AlN layers and layers of a high vapor pressure element were dispersed respectively in the bases of the inventive aluminum alloy samples Nos. 1 to 7. Further, it has been understood that the comparative sample 10 containing Sn, which is the high vapor pressure element, in excess of the proper value defined by the present invention caused aggregation or segregation of Sn on old grain boundaries, to reduce the elongation of the alloy.

As hereinabove described, it is possible to form and disperse AlN coating layers without reducing and in fact even improving the toughness (elongation) in the inventive aluminum alloy.

EXAMPLE 3

TABLE 3

Inventive Sample: Nos. 1 to 3, Comparative Sample Nos.: 4 to 5

| Sample No. | Powder Blending Ratio (%) Powder① | Powder② | Powder③ | Tensile Strength (kgf/mm②) | Elongation (%) | AlN Content (%) | Structural State of Alloy |
|---|---|---|---|---|---|---|---|
| 1 | 80 | 10 | 10 | 41.6 | 1.2 | 7.9 | (B) |
| 2 | 60 | 30 | 10 | 44.4 | 1.6 | 6.2 | (B) |
| 3 | 60 | 20 | 20 | 42.0 | 1.3 | 5.9 | (B) |
| 4 | 100 | 0 | 0 | 37.2 | 0.1 | 9.2 | (A) |
| 5 | 92 | 5 | 3 | 38.8 | 0.3 | 8.6 | (B) |

Powder Composition (in terms of weight)
Powder①: Al-5% Si-2% Cr-1% Zr-0.98% Mg (d av: 78 μm; d min: 20 μm)
Powder②: Al-4% Fe-1% V-1% Mo-0.02% Mg (d av: 72 μm; d min: 25 μm)
Powder③: Al-4% Fe-1% Ti-0.75% Mg-0.50% Sn (d av: 75 μm; d min: 20 μm)
d av: mean grain diameter; d min: minimum grain diameter Samples Nos. 1 to 5 of aluminum alloy powder were prepared by mixing materials in blending ratios shown in Table 3 and molded into green compacts (relative density ratio: 65 to 70%) of 10 by 30 by 10 mm, which in turn were held at a heating temperature of 550° C. for six hours in a heating furnace supplied with nitrogen gas at a flow rate of 3 1/min. and thereafter cooled to ordinary room temperature in a nitrogen atmosphere. The obtained sintered bodies were hot-forged to have a porosity of not more than 3%, and tensile test pieces were prepared from these aluminum alloy samples and subjected to measurement of tensile strength and elongation and structural observation with an optical microscope. Further, the nitrogen gas contents of the respective sample test pieces were quantitatively analyzed for calculating AlN amounts (percent by weight) in the powder aluminum alloy samples. Table 3 shows the results.

The powder ①, the powder ② and the powder ③ are nitriding accelerative Al powder, non-nitrided Al powder and nitriding suppressive Al powder respectively, and Table 3 shows the blending ratios of these powder materials in percent by weight. As to the results of the structural observation, (A) indicates a state in which all old grain boundaries are enclosed with AlN coating layers as shown in FIG. 1, and (B) indicates a state in which coating layers of a high vapor pressure element consisting of one of Sn, Pb, Sb, Bi and S are present simultaneously with old grain boundaries having AlN coating layers dispersed therein while old aluminum grains having no AlN coating layers and such grains having coating layers of the high vapor pressure element in the remaining old grain boundaries were sintered to each other as shown in FIG. 9.

As understood from Table 3, the comparative samples Nos. 4 and 5 prepared by the conventional nitriding exhibited a small elongation of about 0.1 to 0.3 while the elongation was improved to values exceeding 1% in the samples Nos. 1 to 3 satisfying the conditions defined in the present invention. It has also been confirmed from the results of the structural observation with the optical microscope that all old aluminum grain surfaces or grain boundaries were enclosed with AlN coating layers in the comparative sample 4 while AlN coating layers were dispersed in partial old grain boundaries and grains were sintered together in the remaining grain boundaries in the inventive aluminum alloy samples Nos. 1 to 3. In the comparative sample 5 containing the nitriding accelerative Al powder in an excessive amount of 92 percent by weight, on the other hand, sintering between grains progressed so insufficiently that the elongation was not improved.

As hereinabove described, it is possible to form and disperse AlN coating layers without reducing and in fact even improving the toughness (elongation) in the aluminum alloy according to the present invention.

EXAMPLE 4

TABLE 4

Inventive Sample: Nos. 1, 3, Comparative Sample: No. 5

| Sample No. | Powder Blending Ratio (%) Powder ① | Powder ② | Results of Quantitative Analysis in Old Grains with Anger Electron Microscope (wt. %) Powder ① Mg | Sn | Si | Al | Powder ② Mg | Sn | Si | Al |
|---|---|---|---|---|---|---|---|---|---|---|
| 1 | 85 | 15 | 0.82 | <0.01 | 14.2 | rest | 0.01 | <0.01 | 14.5 | rest |
| 3 | 50 | 50 | 0.84 | <0.01 | 14.5 | rest | 0.01 | <0.01 | 14.6 | rest |
| 5 | 100 | 0 | 0.80 | <0.01 | 14.6 | rest | — | — | — | — |

(—: unmeasured due to absence)
Powder Composition (in terms of weight) Powder ①: Al-15% Si-0.89% Mg. Powder ②: Al-15% Si-0.02 %Mg Table 4 shows results (percent by weight) obtained by quantitatively analyzing components contained in old grains of the aluminum alloy powder ① and the powder ② forming the bases of the inventive samples Nos. 1 and 3 and the comparative sample No. 5 in the aluminum alloy samples prepared in Example 1, with an Auger electron microscope.

EXAMPLE 5

TABLE 5

Inventive Sample: Nos. 1, 3, Comparative Sample: No. 8

| Sample No. | Powder Blending Ratio (%) Powder ① | Powder ② | Results of Quantitative Analysis in Old Grains with Anger Electron Microscope (wt. %) Powder ① Mg | Sn | Fe | Ni | Al | Powder ② Mg | Sn | Fe | Ni | Al |
|---|---|---|---|---|---|---|---|---|---|---|---|---|
| 1 | 85 | 15 | 0.71 | <0.01 | 4.0 | 3.9 | rest | 0.31 | 0.58 | 4.1 | 4.0 | rest |
| 3 | 40 | 60 | 0.73 | <0.01 | 3.9 | 3.9 | rest | 0.30 | 0.53 | 4.0 | 3.9 | rest |
| 8 | 100 | 0 | 0.70 | <0.01 | 4.0 | 4.0 | rest | — | — | — | — | — |

(—: unmeasured due to absence)
Powder Composition (in terms of weight) Powder ①: Al-4% Fe-4% Ni-0.75% Mg, Powder ②: Al-4% Fe-4% Ni-0.33% Mg-0.64% Sn Table 5 shows results (percent by weight) obtained by quantitatively analyzing components contained in old grains of the aluminum alloy powder ① and the powder ② forming the bases of the inventive samples Nos. 1 and 3 and the comparative sample No. 8 in the aluminum alloy samples prepared in Example 2, with an Auger electron microscope.

EXAMPLE 6

TABLE 6

Inventive Sample: Nos. 1 to 4, Comparative Sample: Nos. 5 & 6

| Sample No. | Powder Blending Ratio (%) Powder ① | Powder ② | Powder ③ | Holding Time (hr) | Tensile Strength (kgf/mm$^2$) | Elongation (%) | Thickness of AlN Coating Layer ($\mu$m) Maximum | Average |
|---|---|---|---|---|---|---|---|---|
| 1 | 80 | 10 | 10 | 3 | 40.4 | 1.2 | 1.2 | 1.0 |
| 2 | 80 | 10 | 10 | 6 | 42.0 | 1.4 | 1.8 | 1.4 |
| 3 | 60 | 40 | 0 | 9 | 43.8 | 1.5 | 2.5 | 1.9 |
| 4 | 60 | 20 | 20 | 10 | 44.4 | 1.4 | 2.8 | 2.1 |

TABLE 6-continued

Inventive Sample: Nos. 1 to 4, Comparative Sample: Nos. 5 & 6

| Sample | Powder Blending Ratio (%) | | | Holding Time | Tensile Strength | Elongation | Thickness of AlN Coating Layer (μm) | |
|---|---|---|---|---|---|---|---|---|
| No. | Powder ① | Powder ② | Powder ③ | (hr) | (kgf/mm$^2$) | (%) | Maximum | Average |
| 5 | 80 | 10 | 10 | 15 | 35.3 | 0.5 | 3.6 | 2.7 |
| 6 | 60 | 40 | 0 | 15 | 36.1 | 0.3 | 3.9 | 2.9 |

Powder Composition (in terms of weight)
Powder ①: Al-5% Si-2% Cr-1% Zr-0.98% Mg (d av: 78 μm; d min: 20 μm)
Powder ②: Al-4% Fe-1% V-1% Mo-0.02% Mg (d av: 72 μm; d min: 25 μm)
Powder ③: Al-4% Fe-1% Ti-0.75% Mg-0.50% Sn (d av: 75 μm; d min: 20 μm)
d av: mean grain diameter; d min: minimum grain diameter Samples Nos. 1 to 6 of aluminum alloy powder were prepared by mixing materials in blending ratios shown in Table 6 and molded into green compacts (relative density ratio: 65 to 70%) of 10 by 30 by 10 mm, which in turn were held at a heating temperature of 550° C. for periods shown in Table 6 respectively in a heating furnace supplied with nitrogen gas at a flow rate of 3 1/min. and thereafter cooled to ordinary room temperature in a nitrogen atmosphere. The obtained sintered bodies were hot-extruded (extrusion ratio: 12) to have a porosity of not more than 3%, and the respective aluminum alloy samples were subjected to measurement of tensile strength and elongation and structural observation with a scanning electron microscope for measuring maximum thicknesses and average values (based on measurement in view of 20 portions) of AlN coating layers formed and dispersed on old grain boundaries of the alloy bases. Table 6 shows the results. The powder ①, the powder ② and the powder ③ are nitriding accelerative Al powder, non-nitrided Al powder and nitriding suppressive Al powder respectively, and Table 6 describes the blending ratios of these powder materials in percent by weight.

As understood from Table 6, the maximum thicknesses of AlN layers formed and dispersed on old grain boundaries by nitriding exceeded 3 μm in the comparative samples Nos. 5 and 6 and hence stress concentrated in areas where tensile loads were applied, which reduced the strength and the elongation. On the other hand, it has been confirmed that the maximum thicknesses of the AlN coating layers were not more than 3 μm in the inventive samples Nos. 1 and 4, whereby no stress concentration took place on the AlN coating layers in a tensile test, unlike in the comparative samples Nos. 5 and 6, but the mechanical properties of these samples Nos. 1 to 4 were superior to those of the comparative samples Nos. 5 and 6.

As hereinabove described, it is possible to form and disperse AlN coating layers without reducing and in fact even improving the strength and toughness (elongation) of the aluminum alloy according to the present invention.

EXAMPLE 7

TABLE 7

Inventive Sample: Nos. 1 to 5, Comparative Sample: Nos. 6 & 7

| Sample | Powder Blending Ratio (%) | | | Heating Temperature | AlN Content in Aluminum Alloy | |
|---|---|---|---|---|---|---|
| No. | Powder① | Powder② | Powder③ | (° C.) | (wt. %) | Remarks |
| 1 | 70 | 15 | 15 | 480 | 5.9 | |
| 2 | 70 | 15 | 15 | 510 | 6.2 | |
| 3 | 70 | 15 | 15 | 520 | 6.8 | |
| 4 | 70 | 15 | 15 | 550 | 7.5 | |
| 5 | 70 | 15 | 15 | 560 | 7.7 | |
| 6 | 70 | 15 | 15 | 410 | 0.2 | |
| 7 | 70 | 15 | 15 | 600 | 7.6 | coarsening of Si grains in alloy confirmed |

Powder Composition (in terms of weight)
Powder①: Al-5% Si-2% Cr-1% Zr-0.98% Mg (d av: 78 μm; d min: 20 μm)
Powder②: Al-4% Fe-1% V-1% Mo-0.02% Mg (d av: 72 μm; d min: 25 μm)
Powder③: Al-4% Fe-1% Ti-0.75% Mg-0.50% Sn (d av: 75 μm; d min: 20 μm)
d av: mean grain diameter; d min: minimum grain diameter Samples Nos. 1 to 7 of aluminum alloy powder were prepared by mixing materials in blending ratios shown in Table 7 and molded into green compacts (relative density ratio: 65 to 70%) of 10 by 30 by 10 mm, which in turn were held at heating temperatures shown in Table 7 respectively for six hours in a heating furnace supplied with nitrogen gas at a flow rate of 3 1/min. and thereafter cooled to ordinary room temperature in a nitrogen atmosphere. The obtained sintered bodies were hot-extruded (extrusion ratio: 12) to have a porosity of not more than 3%, and the respective aluminum alloy samples were subjected to measurement of AlN contents (percent by weight) by X-ray diffraction. Table 7 shows the results. The powder ①, the powder ② and the powder ③ are nitriding accelerative Al powder, non-nitrided Al powder and nitriding suppressive Al powder respectively.

In the comparative sample No. 6 heated at the low temperature of 410° C., nitriding progressed so insufficiently that AlN coating layers were formed only in a small amount of 0.2 percent by weight, as understood from Table 7. In the inventive samples Nos. 1 to 5, on the other hand, it was possible to develop nitriding by heating the compacts in the proper temperature range in the nitrogen gas atmosphere for forming sufficient AlN coating layers. It is understood that the amounts of AlN formation were remarkably increased in the range of 520° C. to 550° C., in particular, due to further promotion of nitriding. It has been confirmed that growth of Si grains contained in the raw material powder was promoted in the comparative sample No. 7 due to the high heating temperature of 600° C., which damaged the fine structure.

As hereinabove described, it is possible to form and disperse AlN coating layers without reducing and in fact even improving the strength and toughness (elongation) in the aluminum alloy according to the present invention.

Although the present invention has been described and illustrated in detail, it is clearly understood that the description is an illustration and example only and is not to be taken as a limitation, the spirit and scope of the present invention being limited only by the terms of the appended claims.

What is claimed is:

1. An aluminum alloy sintered body comprising:

an aluminum alloy matrix formed by sintering a prior aluminum alloy powder;

AlN layers discontinuously dispersed in said matrix; and nitriding suppressive element layers which are discontinuously dispersed in said matrix and which contain a nitriding suppressive element that suppresses nitriding.

2. The aluminum alloy sintered body in accordance with claim 1, wherein said matrix includes first matrix regions that are enclosed with said AlN layers, and second matrix regions that are not enclosed with said AlN layers and that are interconnected with one another, and wherein said first matrix regions and said second matrix regions are mixed in said matrix.

3. The aluminum alloy sintered body in accordance with claim 2, wherein said matrix does not include grain boundaries that are apparent by optical microscopic examination.

4. The aluminum alloy sintered body in accordance with claim 2, wherein said aluminum alloy matrix contains an aluminum alloy and a nitriding accelerative element that accelerates nitriding, and a proportional content of said nitriding accelerative element is greater in said first matrix regions that are enclosed with said AlN layers than in said second matrix regions that are not enclosed with said AlN layers.

5. The aluminum alloy sintered body in accordance with claim 4, wherein said nitriding accelerative element is selected from a group consisting of Mg, Ca and Li and combinations thereof.

6. The aluminum alloy sintered body in accordance with claim 2, wherein said aluminum alloy matrix contains an aluminum alloy, a nitriding accelerative element that accelerates nitriding and said nitriding suppressive element that suppresses nitriding, said first matrix regions that are enclosed with said AlN layers have a proportional content of said nitriding accelerative element of at least 0.05 percent by weight and a proportional content of said nitriding suppressive element of less than 0.01 percent by weight, and said second matrix regions that are not enclosed with said AlN layers have a proportional content of said nitriding accelerative element of less than 0.05 percent by weight.

7. The aluminum alloy sintered body in accordance with claim 1, wherein said nitriding suppressive element is selected from a group consisting of Sn, Pb, Sb, Bi and S and combinations thereof.

8. The aluminum alloy sintered body in accordance with claim 1, wherein said matrix includes first matrix regions that are enclosed with said AlN layers and second matrix regions that are enclosed with said nitriding suppressive element layers, and wherein said first matrix regions and said second matrix regions are mixed in said matrix.

9. The aluminum alloy sintered body in accordance with claim 8, wherein said aluminum alloy matrix contains an aluminum alloy, a nitriding accelerative element that accelerates nitriding and said nitriding suppressive element that suppresses nitriding, said first matrix regions that are enclosed with said AlN layers have a proportional content of said nitriding accelerative element of at least 0.05 percent by weight and a proportional content of said nitriding suppressive element of less than 0.01 percent by weight, and said second matrix regions that are enclosed with said nitriding suppressive layers have a proportional content of said nitriding accelerative element of at least 0.05 percent by weight and a proportional content of said nitriding suppressive element of at least 0.01 percent by weight and not more than 2 percent by weight.

10. The aluminum alloy sintered body in accordance with claim 8, wherein said second matrix regions are interconnected with each other by sinter bonding through said nitriding suppressive element layers.

11. The aluminum alloy sintered body in accordance with claim 1, wherein said aluminum alloy matrix includes grains of said prior aluminum alloy powder with grain boundaries therebetween, and said AlN layers are discontinuously dispersed along said grain boundaries.

12. The aluminum alloy sintered body in accordance with claim 11, wherein said AlN layers only partially enclose at least some of said grains.

13. The aluminum alloy sintered body in accordance with claim 11, wherein said AlN layers completely enclose some of said grains without enclosing remaining ones of said grains.

14. The aluminum alloy sintered body in accordance with claim 13, wherein said remaining ones of said grains are interconnected by sinter bonding.

15. The aluminum alloy sintered body in accordance with claim 13, wherein said aluminum alloy matrix contains an aluminum alloy and a nitriding accelerative element that accelerates nitriding, and a proportional content of said nitriding accelerative element is greater in said some grains that are enclosed with said AlN layers than in said remaining grains that are not enclosed with said AlN layers.

16. The aluminum alloy sintered body in accordance with claim 15, wherein said nitriding accelerative element is selected from a group consisting of Mg, Ca and Li and combinations thereof.

17. The aluminum alloy sintered body in accordance with claim 13, wherein said aluminum alloy matrix contains an aluminum alloy, a nitriding accelerative element that accelerates nitriding and said nitriding suppressive element that suppresses nitriding, said some grains that are enclosed with said AlN layers have a proportional content of said nitriding accelerative element of at least 0.05 percent by weight and a proportional content of said nitriding suppressive element of less than 0.01 percent by weight, and said remaining grains that are not enclosed with said AlN layers have a proportional content of said nitriding accelerative element of less than 0.05 percent by weight.

18. The aluminum alloy sintered body in accordance with claim 11, wherein said nitriding suppressive element layers are discontinuously dispersed along said grain boundaries.

19. The aluminum alloy sintered body in accordance with claim 18, wherein said AlN layers at least partially enclose some of said grains and said nitriding suppressive element layers completely enclose others of said grains.

20. The aluminum alloy sintered body in accordance with claim 19, wherein some of said grains are not enclosed with either or both of said AlN layers and said nitriding suppressive layers.

21. The aluminum alloy sintered body in accordance with claim 19, wherein some of said grains are completely enclosed with said AlN layers.

22. The aluminum alloy sintered body in accordance with claim 19, wherein said aluminum alloy matrix contains an aluminum alloy, a nitriding accelerative element that accelerates nitriding and said nitriding suppressive element that suppresses nitriding, said some grains that are at least partially enclosed with said AlN layers have a proportional content of said nitriding accelerative element of at least 0.05 percent by weight and a proportional content of said nitriding suppressive element of less than 0.01 percent by weight, and said other grains that are enclosed with said nitriding suppressive layers have a proportional content of said nitriding accelerative element of at least 0.05 percent by weight and a proportional content of said nitriding suppressive element of at least 0.01 percent by weight and not more than 2 percent by weight.

23. The aluminum alloy sintered body in accordance with claim 18, wherein said nitriding suppressive element is selected from a group consisting of Sn, Pb, Sb, Bi and S and combinations thereof.

24. The aluminum alloy sintered body in accordance with claim 18, wherein some of said grains are each respectively partially enclosed with said AlN layers and partially enclosed with said nitriding suppressive element layers.

25. The aluminum alloy sintered body in accordance with claim 24, wherein some of said grains are completely enclosed with said nitriding suppressive element layers.

26. The aluminum alloy sintered body in accordance with claim 25, wherein some of said grains are not enclosed with either or both of said AlN layers and said nitriding suppressive layers.

27. An aluminum alloy sintered body comprising:

an aluminum alloy matrix formed by sintering a prior aluminum alloy powder;

AlN layers discontinuously dispersed in said matrix; and nitriding suppressive element layers containing a nitriding suppressive element that suppresses nitriding;

wherein said aluminum alloy matrix includes grains of said prior aluminum alloy powder with grain boundaries therebetween, and said AlN layers and said nitriding suppressive element layers are respectively discontinuously dispersed along said grain boundaries.

28. The aluminum alloy sintered body in accordance with claim 27, wherein said AlN layers at least partially enclose some of said grains and said nitriding suppressive element layers completely enclose others of said grains.

29. The aluminum alloy sintered body in accordance with claim 28, wherein some of said grains are not enclosed with either or both of said AlN layers and said nitriding suppressive layers.

30. The aluminum alloy sintered body in accordance with claim 28, wherein some of said grains are completely enclosed with said AlN layers.

31. The aluminum alloy sintered body in accordance with claim 28, wherein said aluminum alloy matrix contains an aluminum alloy, a nitriding accelerative element that accelerates nitriding and said nitriding suppressive element that suppresses nitriding, said some grains that are at least partially enclosed with said AlN layers have a proportional content of said nitriding accelerative element of at least 0.05 percent by weight and a proportional content of said nitriding suppressive element of less than 0.01 percent by weight, and said other grains that are enclosed with said nitriding suppressive layers have a proportional content of said nitriding accelerative element of at least 0.05 percent by weight and a proportional content of said nitriding suppressive element of at least 0.01 percent by weight and not more than 2 percent by weight.

32. The aluminum alloy sintered body in accordance with claim 27, wherein said nitriding suppressive element is selected from a group consisting of Sn, Pb, Sb, Bi and S and combinations thereof.

33. The aluminum alloy sintered body in accordance with claim 27, wherein some of said grains are each respectively partially enclosed with said AlN layers and partially enclosed with said nitriding suppressive element layers.

34. The aluminum alloy sintered body in accordance with claim 33, wherein some of said grains are completely enclosed with said nitriding suppressive element layers.

35. The aluminum alloy sintered body in accordance with claim 34, wherein some of said grains are not enclosed with either or both of said AlN layers and said nitriding suppressive layers.

* * * * *

UNITED STATES PATENT AND TRADEMARK OFFICE

CERTIFICATE OF CORRECTION

PATENT NO. : 6,042,631
DATED : March 28, 2000
INVENTOR(S) : Kondoh et al.

It is certified that error appears in the above-identified patent and that said Letters Patent is hereby corrected as shown below:

Col. 18, TABLE 2, Col. 3, under the heading "Powder ②", line 9, replace "5(③ -1)" by --5(② -1)--.

Signed and Sealed this

Sixth Day of March, 2001

*Attest:*

Nicholas P. Godici

NICHOLAS P. GODICI

*Attesting Officer*

*Acting Director of the United States Patent and Trademark Office*